US005105474A

United States Patent [19]

Skinner

[11] Patent Number: 5,105,474

[45] Date of Patent: Apr. 21, 1992

[54] WET SUIT WITH SUPPORT BELT, KNEE PADS AND SHIN GUARDS

[76] Inventor: Pam Skinner, 10371 Westminster Blvd., Garden Grove, Calif. 92643

[21] Appl. No.: 594,409

[22] Filed: Oct. 9, 1990

[51] Int. Cl.[5] ..... A41D 1/08

[52] U.S. Cl. ..... 2/2.1 R; 2/69; 2/227; 2/79; 2/82; 2/236

[58] Field of Search ..... 2/21 R, 227, 69, 79, 2/82, 236, 267

[56] References Cited

U.S. PATENT DOCUMENTS

| | | | |
|---|---|---|---|
| 3,731,319 | 5/1973 | Oneill | 2/2.1 R |
| 3,771,169 | 11/1973 | Edmund | 2/2.1 R |
| 4,293,957 | 10/1981 | Melarvie | 2/2.1 R |
| 4,547,904 | 10/1985 | Long et al. | 2/2.1 R |
| 4,722,710 | 2/1988 | Hagen et al. | 2/2.1 R |
| 4,862,517 | 9/1989 | Meistrell | 2/2.1 R |

*Primary Examiner*—Werner H. Schroeder
*Assistant Examiner*—Gloria Hale
*Attorney, Agent, or Firm*—Beech & Collins

[57] ABSTRACT

A wet suit pant that provides an easy method for being pulled on or taken off. The pant legs have a zipper from the ankle opening to the thigh or crotch area which opens from the ankle. When the zippers are open, the tight fitting pant can be easily pulled up to the waist as if they were shorts and then the legs zipped for a tight, warm fit. The pant has a top belt which wraps around the waist and is secured to support back muscles and kidneys. The back of the belt area has guards to protect the back from injury. The zipper feature allows use of knee pads, shin guards and other devices under the pant legs next to the body.

11 Claims, 3 Drawing Sheets

WET SUIT WITH SUPPORT BELT, KNEE PADS AND SHIN GUARDS

FIELD OF THE INVENTION

The present invention relates to an improved wet suit pants that are easy to pull on and take off while still providing the necessary warmth. The improved pants additionally provide knee and shin protection as well as back and kidney protection. The pants can also accommodate knee braces and other devices not part of the inventive device.

DESCRIPTION OF RELATED ART

The wet suit is a well known, close fitting usually one-piece suit of rubber or neoprene, worn by skin divers, jet ski racers, surfers and others for warmth when engaged in activities associated with cold water. Other forms of wet suit clothing include jackets, vests and pants. Whether the pants are part of a complete suit or are separate from a jacket or vest, they are generally closed stitched except perhaps for a small zipper opening near the ankle. The purpose of this common configuration is to provide the necessary warmth relative to the cold water activity in which an individual is engaged. However, this makes for a close fitting device which is difficult to pull on and take off of a persons lower body. In addition, such pants cannot accommodate other devices such as knee braces or shin guards underneath the pants. Although doctors usually recommend braces be worn next to the body, such protective devices or other objects must be worn outside, over the wet suit pants.

The instant wet suit pants provide an easier method for pull on and removal of the pants. The provision of a zipper that runs from the ankle opening to the top of the thigh or to the crotch and which zipper opens from the ankle up allows this ease. In addition the zipper feature allows objects such as knee or shin guards to be placed inside the pants in pockets or attached to the body in order to provide maximum protection.

SUMMARY OF THE INVENTION

A primary objective of the present invention is to provide an easy to pull on and take off wet suit pants. Another object of the invention is to allow the installation of protective equipment such as knee or shin guards in pockets in the pants or braces and other devices attached to the body. A further object of the invention is to provide a kidney belt and built in back guard for kidney and lower back muscle protection and for protection against any hard object hitting the back. In accordance with the description presented herein other objects of the this invention will become apparent when the description and drawings are reviewed.

DESCRIPTION OF THE PREFERRED EMBODIMENT

The wet suit pants are a close fitting pair of pants made out of rubber, neoprene or other suitable material for warmth in cold environments such as water, snow or other cold conditions. The pants fit tight to the body, yet have leg zippers running from the ankle opening to the top of the thigh or to the crotch which zipper opens from the ankle up to provide ease of pulling on and taking off the pants. The pants are especially useful for accommodating protective devices such as knee or shin pads inside the pants next to the body.

Figure 1:
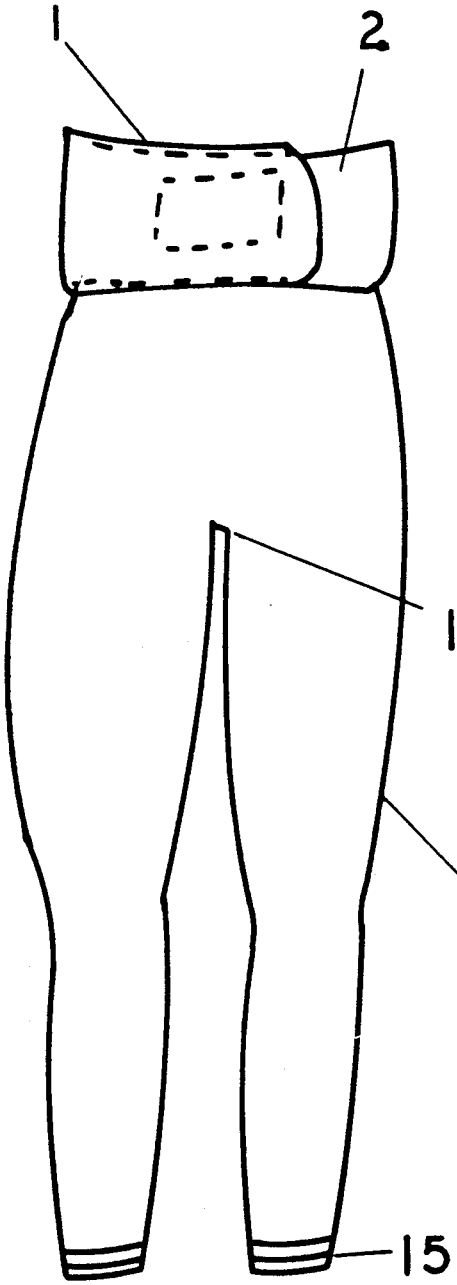
FIG. 1 illustrates a front view of the wet suit pants.
Figure 2:
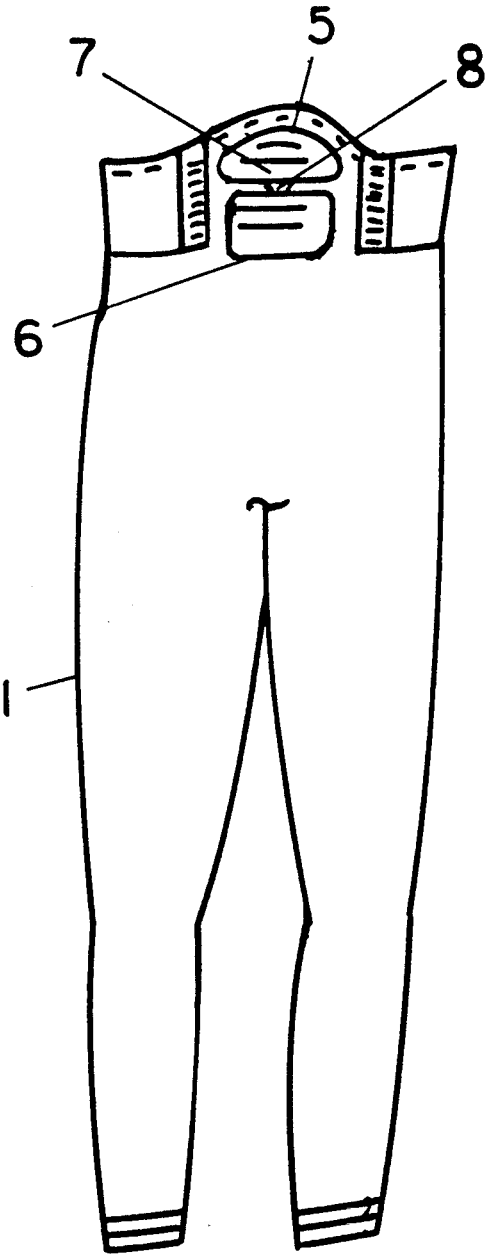
FIG. 2 illustrates a back view of the pants.
Figure 3:
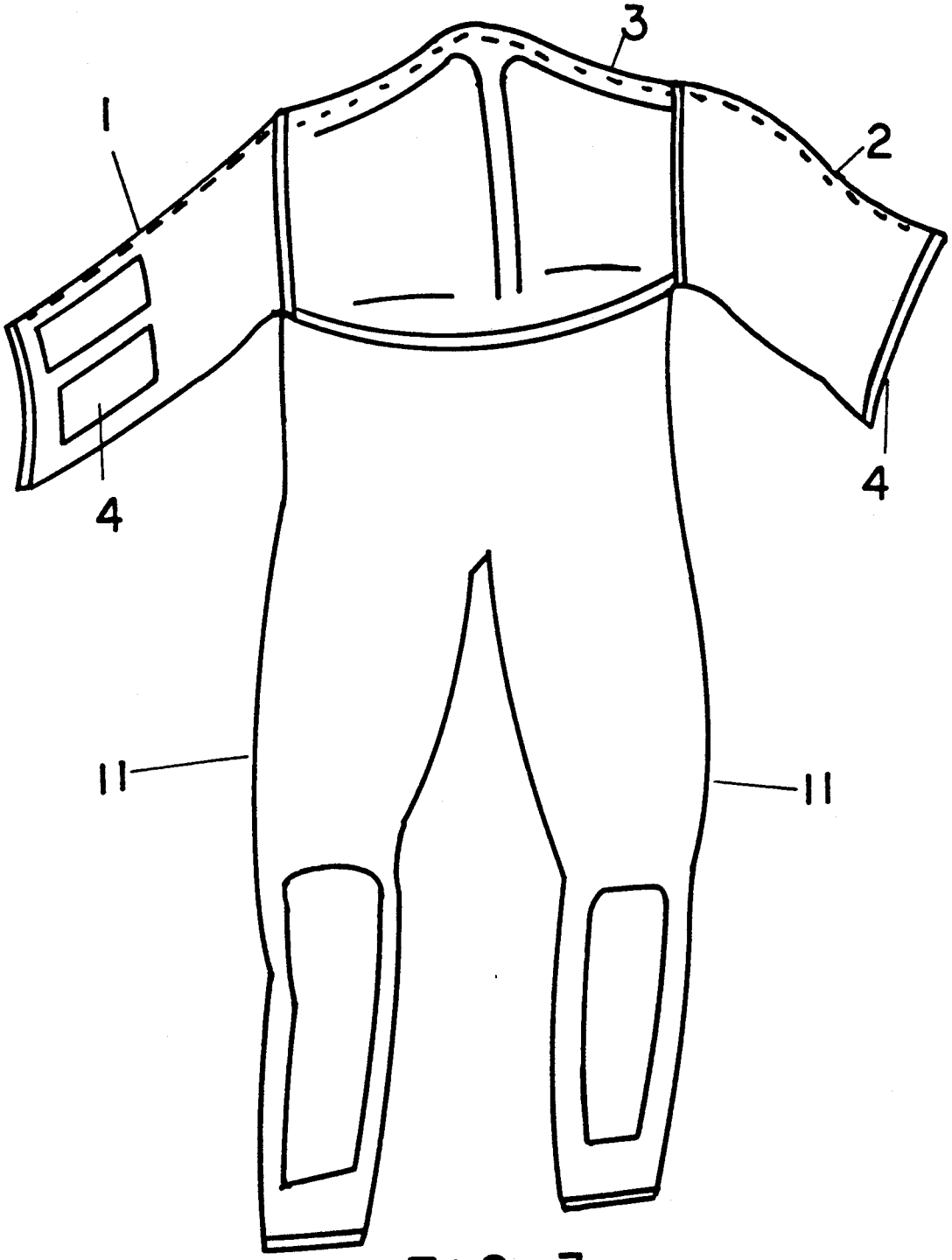
FIG. 3 illustrates a front view with the belt open.
Figure 4:
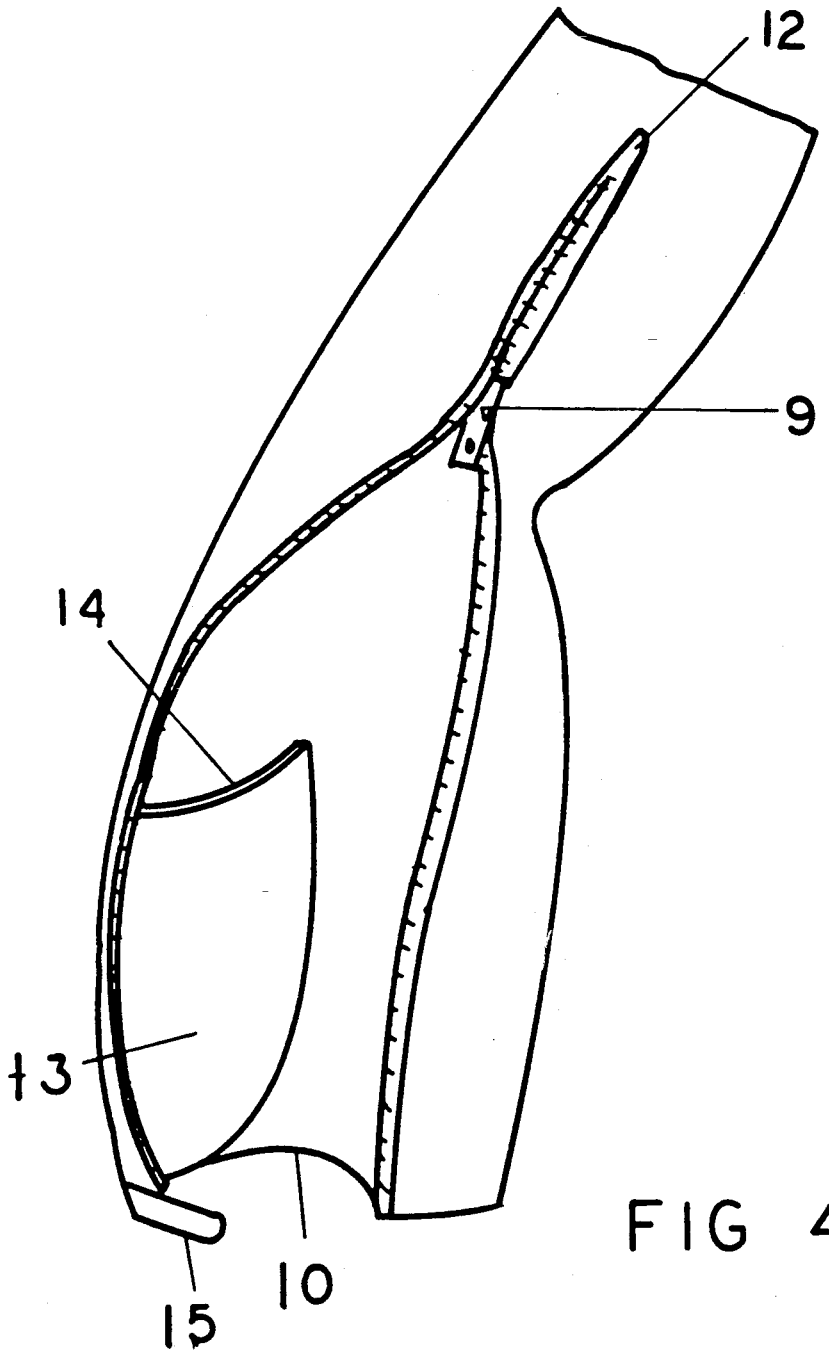
FIG. 4 illustrates a side view of the pants with the leg zipper open.

Referring to FIGS. 1 through 4, a pair of wet suit pants has a right belt (1) and left belt (2) attached to a back member (3). The right belt (1) and left belt (2) have attachment (4) such as Velcro or other suitable means to hold the right belt (1) and left belt (2) tight around a persons waist when closed and fastened by the attachment (4). The right belt (1), left belt (2) and back member (3) are of sufficient width to provide support to the back muscles and kidneys of the person wearing the pants. The back support member (3) is above the seat of the pants at a person's waist when worn and is either a continuous piece of the wet suit pants material or if separate is attached to the wet suit material above the seal of the pants defined as the top back portion of the pants.

The back member (3) also has attached to it on the side away from the body on the outside of the pants an upper guard (5) and lower guard (6) which can be made of plastic or other stiff material to provide external protection for a person's back. The upper guard (5) has a projection (7) which fits into an aperture (8) defined in lower guard (6). This allows the person to bend backward at the waist to some degree while providing maximum protection and stiff support.

The wet suit pants have a zipper (9) which runs from the open ankle aperture (10) of the pants leg (11) to the thigh (12) and which zipper opens from the ankle up. Other zipper (9) locations are also possible such as running from the ankle aperture (10) on the inside of the pants leg (11) up to the crotch (16). The zipper (9) when open allows easy slip on of the pants and then when closed provides the warmth and protection.

Interior to the pants leg (11) is a pocket (13) defining a leg aperture (14). The pocket (13) can be sized to hold a knee pad or a knee and shin guard. The pants leg (11) can be sized to accommodate various sized, shapes and configuration of protective devices whether installed in the pocket (13) or attached to the legs of the person wearing the pants.

The ankle aperture (10) has a strap (15) which uses Velcro or other suitable fasteners to wrap around and hold the ankle aperture (10) and zipper (9) closed.

I claim:

1. A pair of wet suit pants comprising: a right belt and left belt, a back member, a top back portion having a center on an outside surface of the pants and a bottom portion wherein the right belt and left belt are attached to a back member with the right belt and left belt having an attachment means for holding firmly around the waist of a person when joined;

the back member being attached to a part of the top back portion of the pants and the right belt, left belt and back member being of sufficient width to provide support to a person's back muscles and kidneys when firmly closed:

the back member also has attached to its center on an outside surface of the pants an upper guard and a lower guard spaced sufficiently apart to allow a person to bend backwards at the waist a limited degree before the upper guard and the lower guard contact;

and the bottom portion of the pants having a leg with a zipper which runs from an ankle aperture of the leg to a thigh top area where the zipper opens from the ankle aperture.

2. The pair of wet suit pants as in claim 1 wherein they are made of neoprene rubber.

3. The upper guard and the lower guard as in claim 1 wherein they are made of plastic.

4. The upper guard and the lower guard as in claim 1 wherein the upper guard has a projection and the lower guard defines an aperture where the projection and aperture are located such that when a person bends back at the waist the projection slides into the aperture.

5. The leg as in claim 1 wherein the leg has a pocket which will accept and hold a knee pad.

6. The pocket as in claim 5 wherein the pocket will accept and hold a knee pad and shin guard.

7. The leg as in claim 2 wherein the leg has a strap with an attachment means to wrap around the ankle aperture to securely close the ankle.

8. The right belt and the left belt as in claim 1 wherein the attachment means is a hook and loop type fastener.

9. The leg as in claim 1 wherein a zipper in the leg runs from the ankle aperture to a crotch area.

10. The leg as in claim 1 wherein a zipper in the leg runs from the ankle aperture up the back of the leg to below a buttock area of the wet suit pants.

11. The leg as in claim 1 wherein a zipper runs from the ankle aperture up the front of the leg to the front of a hip area of the pants.

* * * * *